US006692385B2

(12) United States Patent
Walker, Jr. et al.

(10) Patent No.: US 6,692,385 B2
(45) Date of Patent: Feb. 17, 2004

(54) SHOT MAKING TRAINING APPARATUS AND METHOD

(75) Inventors: Lenard E. Walker, Jr., Detroit, MI (US); Cedric L. Kinlow, Detroit, MI (US)

(73) Assignee: Radar Rim Holdings, LLC, West Bloomfield, MI (US)

( * ) Notice: Subject to any disclaimer, the term of this patent is extended or adjusted under 35 U.S.C. 154(b) by 0 days.

(21) Appl. No.: 10/118,424

(22) Filed: Apr. 8, 2002

(65) Prior Publication Data

US 2003/0190981 A1 Oct. 9, 2003

(51) Int. Cl.[7] ..... A63B 69/00
(52) U.S. Cl. ..... 473/447
(58) Field of Search ..... 473/447, 448, 473/449, 485, 470; 273/400

(56) References Cited

U.S. PATENT DOCUMENTS

| | | | | |
|---|---|---|---|---|
| 602,517 A | | 4/1898 | McFadden | |
| D110,225 S | * | 6/1938 | Schutt | D21/702 |
| 3,602,505 A | | 8/1971 | Friend | |
| 4,611,812 A | | 9/1986 | Morrison | |
| 5,665,016 A | | 9/1997 | Burnett | |
| 5,810,679 A | | 9/1998 | Yoakum | |
| 5,827,136 A | | 10/1998 | Halter et al. | |
| 5,893,809 A | | 4/1999 | Coats et al. | |
| 6,159,111 A | | 12/2000 | Purcell | |
| 6,343,998 B1 | * | 2/2002 | Tarulli et al. | 473/273 |

OTHER PUBLICATIONS

Beachbasketball web page, 1998, www.beachbasketball.com, 10 pages.*

* cited by examiner

*Primary Examiner*—Gregory Vidovich
*Assistant Examiner*—M. Chambers
(74) *Attorney, Agent, or Firm*—MacMillan, Sobanski & Todd, LLC

(57) ABSTRACT

An athletic skill training apparatus includes a generally horizontal upper ring that defines an upper opening, preferably circular and the same diameter as a traditional basketball hoop, made from a strong, lightweight material. Three lower rings are attached to the upper ring and extend downwardly and inwardly to attach to a shock absorbing base member. The base member includes an upwardly extending projection with a rounded upper surface that tapers downwardly and outwardly to direct the basketball out of the lower rings. The rings and the base member form a goal assembly that is mounted on a support assembly telescopic post for use by children and adults.

11 Claims, 5 Drawing Sheets

SHOT MAKING TRAINING APPARATUS AND METHOD

BACKGROUND OF THE INVENTION

The present invention relates generally to an apparatus for providing sports training and, in particular, to a shot making training apparatus and method such as for basketball.

An essential skill in basketball is the ability to make field goal, two point and/or three point, and free throw shots. Improving the accuracy of field goal and free throw shots, therefore, is a continuing desire of most basketball players. Shooting a basketball at a hoop by oneself in an effort to improve one's shot-making ability, however, can be a tedious task at best and time-consuming and inefficient at worst. Missed shots are always a problem because the balls must be chased down. Successful shots, though, are also a problem because the net is designed to cause the ball to drop to the playing floor immediately below the rim. A player then is forced to move from his or her shooting location to the basket in order to retrieve the ball and then move to another shooting location, which is inefficient and time-consuming. A subsequent successful shot means the process outlined above begins again.

The art has recognized these practice deficiencies and has provided numerous devices for improving the accuracy of a player's shots. Many of these devices are disadvantageously designed to be attached to basketball rims, limiting the use of the device to locations having an installed basketball rim. Those devices that are not designed to be attached to existing basketball rims are often bulky and difficult to transport and assemble. Other types of practice devices are targets or goals that reward the user for successful shots, and/or reduce the area of the hoop through which the basketball must pass, such as concentric hoops for improving accuracy. Many devices include a means to return the ball to the user after completion of a successful shot by the use of ramps, chutes or the like directing the ball to a single designated spot adjacent the basketball goal with the purpose of making shooting practice time more efficient. These devices return the ball to the same location after a successful shot thereby rendering them useless in practicing shots from other locations. Furthermore, in actual playing conditions, basketball shots are often taken while moving. Another essential skill in basketball, therefore, is the ability to move laterally, which is not an element of the prior art basketball training devices.

It is desirable, therefore, to provide an apparatus for providing training to basketball players that will work on a player's shot-making ability and lateral movement. Such apparatus can be used in any other type of shot making game or skill contest. It is also desirable to provide a shot making training apparatus that is portable, lightweight, and easy to use. It is also desirable to provide a shot making training apparatus that may be used by young children as well as adults. It is also desirable to provide a shot making training apparatus that is easy to assemble, disassemble, and transport.

SUMMARY OF THE INVENTION

The present invention concerns a shot making training apparatus and method for improving a player's shot and the player's lateral movement. The training apparatus includes a generally horizontal upper ring that defines an upper opening of a goal assembly. The ring is preferably circular and the same diameter as a traditional basketball hoop and is constructed of a lightweight material that is both strong and light including, but not limited to, aluminum, high-strength injection molded plastic materials, and the like. Three lower rings are attached at respective tangential points to the horizontal ring and extend downwardly and inwardly therefrom to attach at another respective tangential point to a shock absorbing base member. The upper ring, lower rings, and shock absorbing base member form a goal assembly. The lower rings are preferably the same diameter and constructed of the same material as the upper ring. However, the upper ring and the lower rings can be of any suitable size and shape depending upon the game to be played or the skill contest. The shock absorbing base member includes a projection extending from a center portion of an upper surface thereof. The projection includes a rounded upper surface that tapers downwardly and outwardly to the upper surface of the shock absorbing base member. The shock absorbing base member preferably includes springs or dampers that absorb the force of the ball upon impact and facilitates the ball to exit the lower openings rather than impacting the surface of the projection and rebounding out the upper opening.

A lower surface of the shock absorbing base member is adapted to be attached to an upper portion of an elongated, telescoping pole. The pole is adjustable in length from a retracted lower position, suitable for use with children, to an extended position, such as a regulation ten foot height, to be used by taller children and adults alike. The lower portion of the pole is operable to be mounted to the ground or a playing surface.

In operation, the apparatus according to the present invention is assembled and adjusted to the desired height. The player shoots the ball with the objective of passing the ball through the upper ring defining the upper opening of the goal assembly. When a successful shot is made, the ball will fall onto the sloped surface of the projection. Depending on where the ball contacts the sloped surface, the ball will be directed to exit one of the respective lower openings. The ball may pass through one of the openings so that the ball is returned close to the shot release point. The ball may also pass through either of the other two openings, which will force the player to move laterally to retrieve the ball in order to take another shot.

The training apparatus according to the present invention thus places a premium on a player's shot-making ability, but also improves a player's lateral movement. A player can practice stationary shots, both jump shots and free throws, as well as practice the ability to make a successful shot while moving laterally, simulating real-game situations. The training apparatus provides repetition necessary to develop an improved shot. The training apparatus is advantageously lightweight, easy to assemble and does not require the use of an existing backboard and rim assembly.

A method of using the training apparatus according to the present invention for training and/or game playing can be practiced by:

(a) providing a goal assembly according to the present invention;

(b) providing a ball to a player;

(c) shooting the ball for a predetermined number of shots from one or more locations; and (d) tabulating a score based on at least one of the number of successful shots per attempted shots, the number of successful shots made in a row, and location of the ball as it exits the goal assembly.

While the training apparatus according to the present invention is useful for training basketball players, it can be utilized with other types of balls for playing a variety of games and skill contests.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
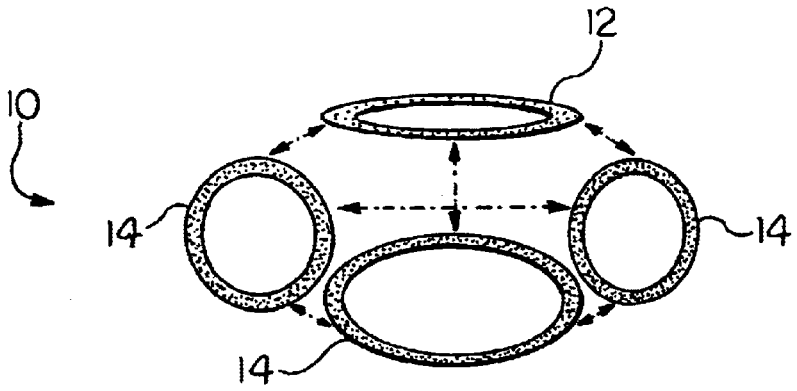
FIG. 1 is an exploded perspective view of a training apparatus in accordance with the present invention.

Referring now to FIG. 1, a training apparatus in accordance with the present invention is indicated schematically at 10. The training apparatus 10 includes an upper ring 12 and a plurality of lower rings 14. Preferably, the upper ring 12 and the lower rings 14 are circular and of the same diameter as a regulation basketball hoop. However, the upper ring 12 and the lower rings 14 can be of any suitable size and shape for playing games and skill contests with different size balls or other objects. The upper ring 12 defines an upper opening and each of the lower rings 14 defines a respective lower opening extending therethrough. The upper ring 12 and the lower rings 14 are preferably constructed of a lightweight material that is both strong and light including, but not limited to, aluminum, high-strength injection molded plastic materials, and the like.

Figure 2:
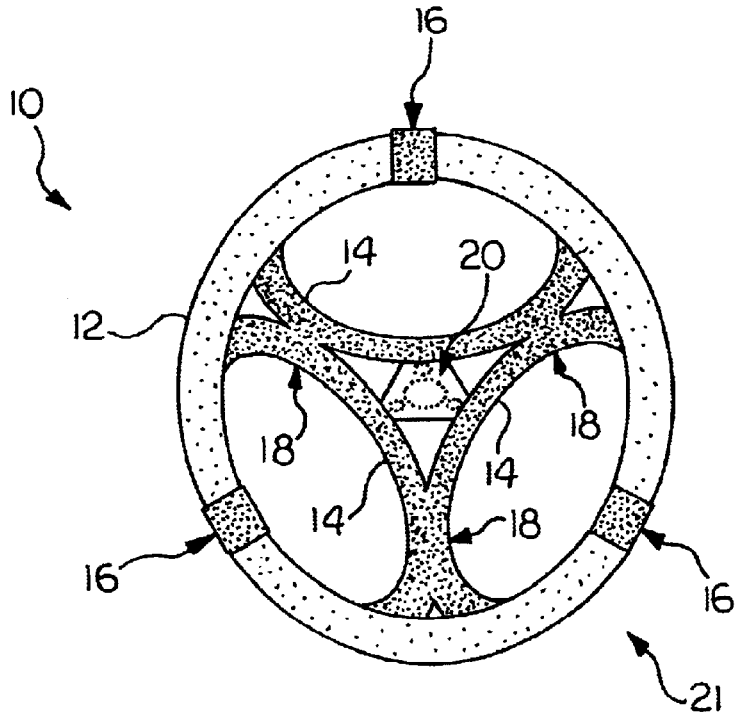
FIG. 2 is top plan view of the apparatus in FIG. 1 in an assembled configuration.

Referring now to FIG. 2, the upper ring 12 is shown attached to each of the lower rings 14 at respective tangential points by respective attachment members 16. The attachment members 16 are preferably hook and loop straps or similar releasable attachment means. Each of the lower rings 14 is attached to the adjacent lower ring 14 by respective attachment members 18. The attachment members 18 are preferably hook and loop straps or similar releasable attachment means. When attached, each of the lower rings 14 extends downwardly and inwardly from the upper ring 12 to attach to a shock absorbing base member 20 by a bottom portion thereof.

Figure 3:
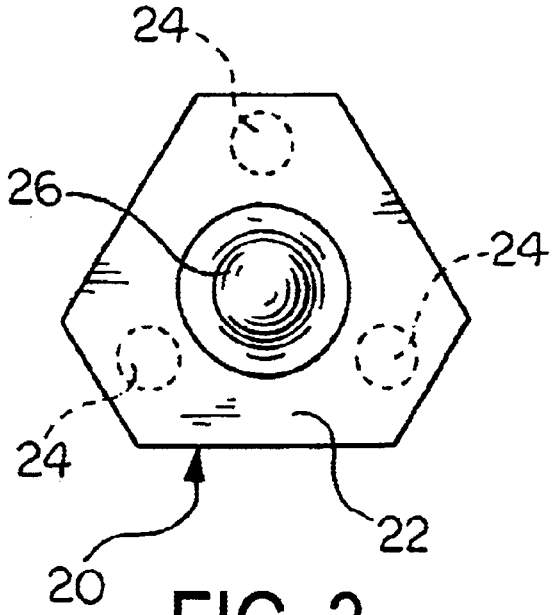
FIG. 3 is a top plan view of the shock absorbing base member shown in FIG. 2 in accordance with the present invention.
Figure 4:
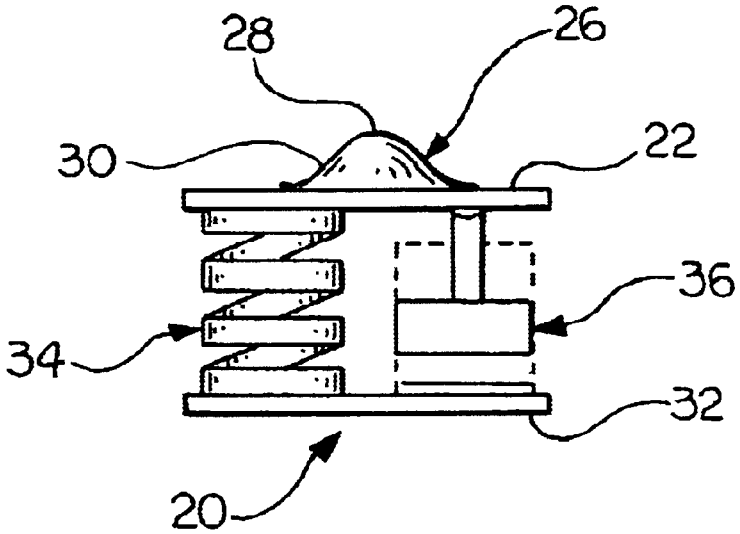
FIG. 4 is a side elevation view of the base member of FIG. 3.
Figure 5A:
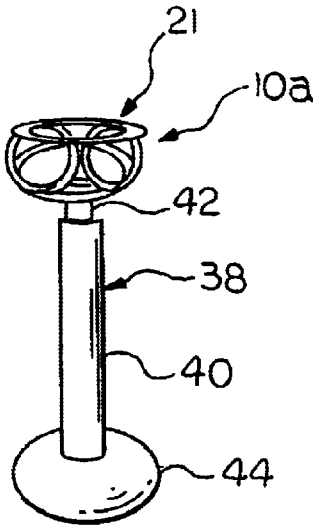
FIG. 5*a* is a perspective view of the training apparatus of FIG. 1 shown attached to a rigid base member in a retracted position.
Figure 5B:
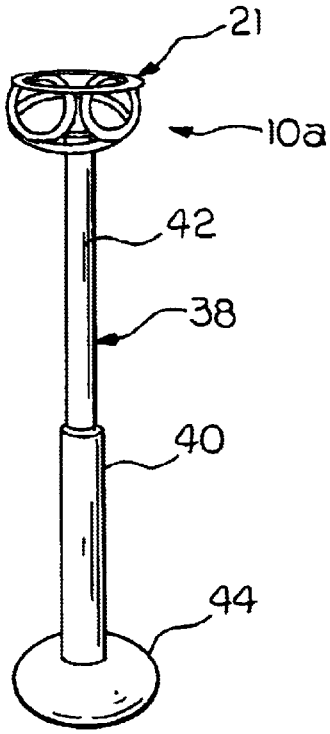
FIG. 5*b* is a perspective view of the training apparatus and rigid base member of FIG. 5*a* in an extended position.
Figure 7:
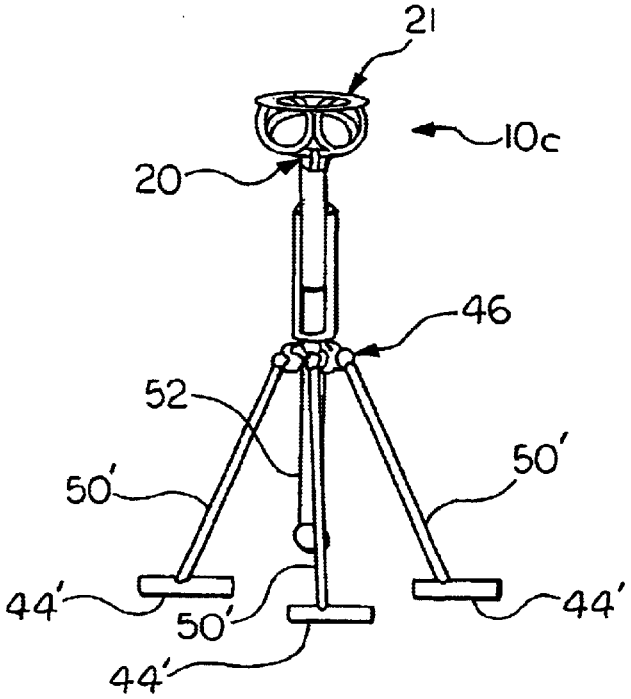
FIG. 7 is a perspective view of the training apparatus of FIG. 1 shown attached to an alternative embodiment self-righting base member.
Figure 6:
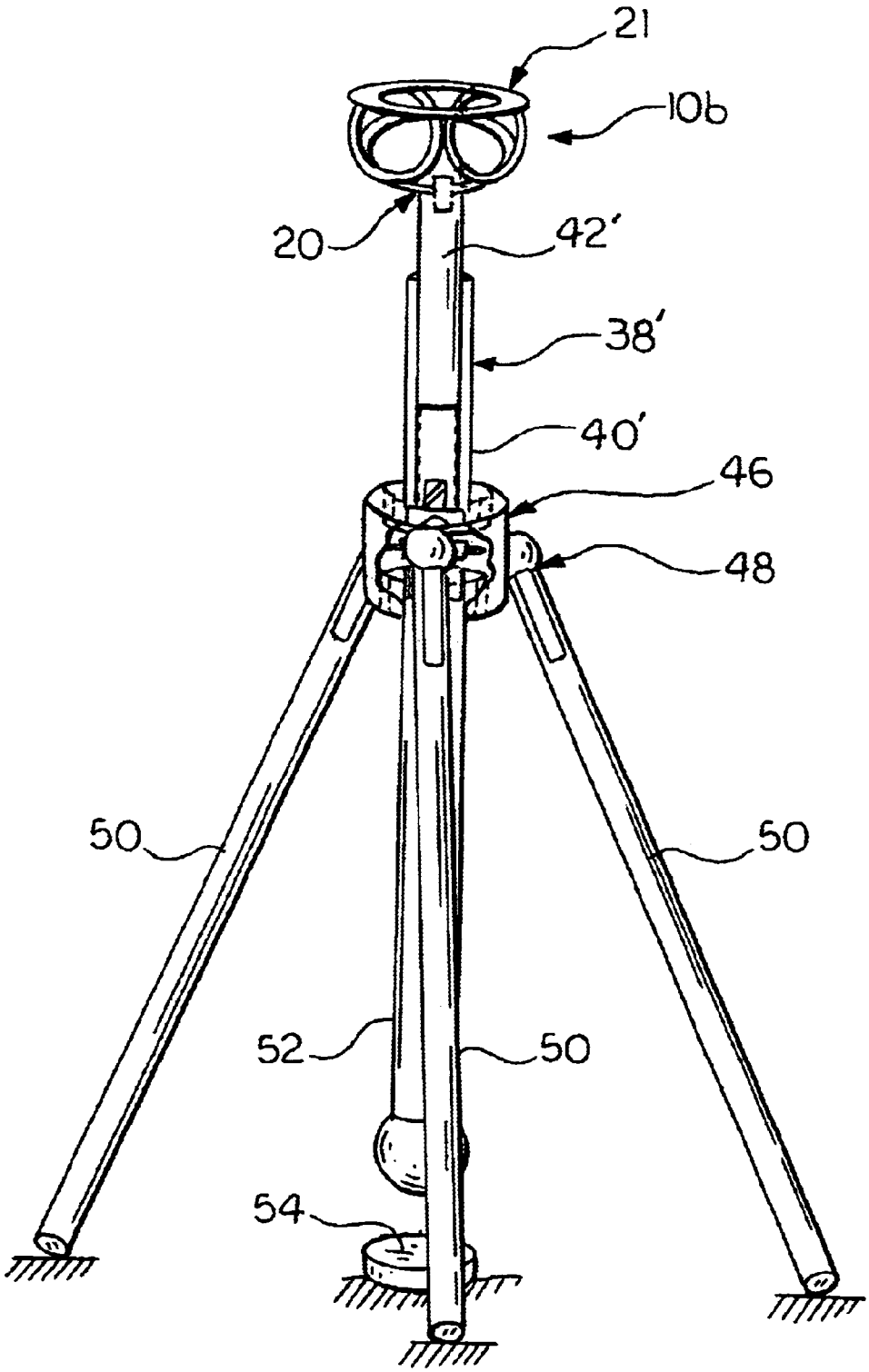
FIG. 6 is a perspective view of the training apparatus of FIG. 1 shown attached to a self-righting base member.
Figure 8:
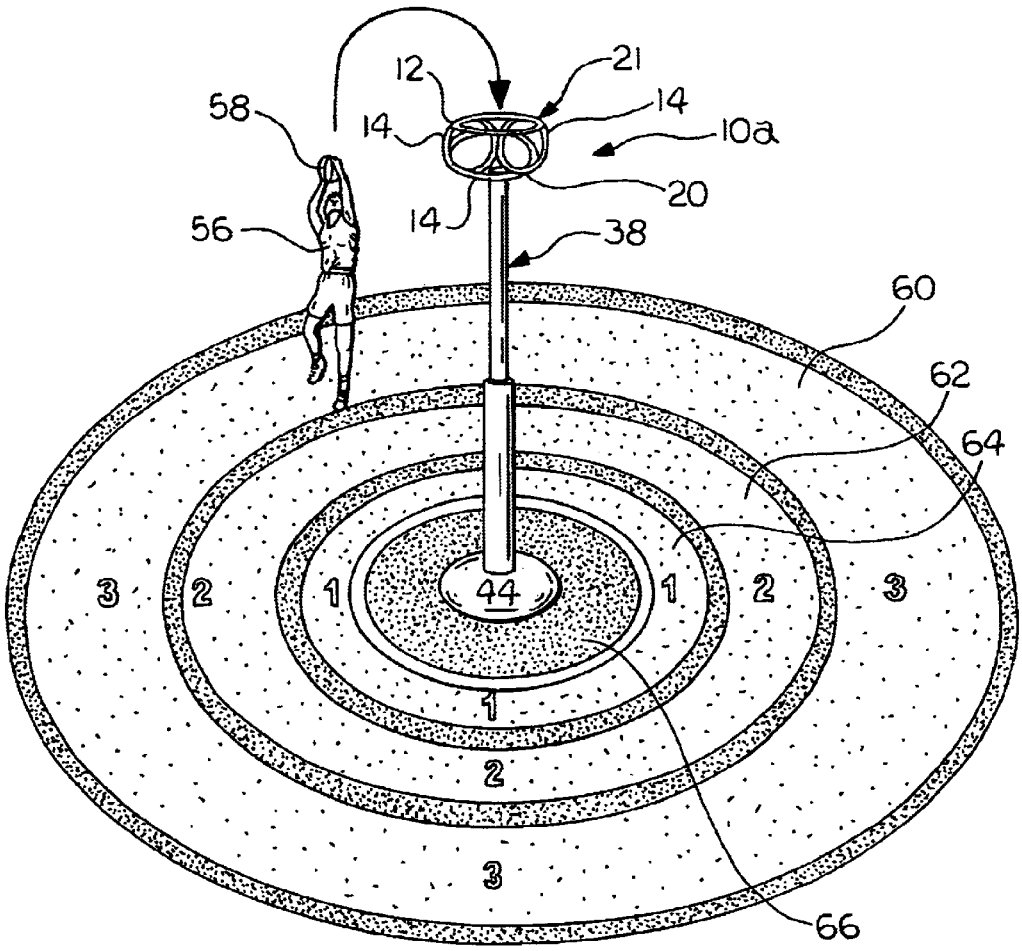
FIG. 8 is a perspective view of the training apparatus of FIG. 5*b* shown in use with a basketball and player.

Referring now to FIG. 3, a top plan view of the base member 20 is shown. The base member 20 includes an upper plate 22 and a lower plate 32 preferably connected by a shock absorbing means such as a plurality of springs 34 interposed between a lower surface of the upper plate 22 and an upper surface of the lower plate 32. Alternatively, the upper plate 22 and the lower plate 32 are connected by a plurality of dampers 36, or by a combination of both springs 34 and dampers 36. The damper 36 can be any suitable device such as a fluid filled shock absorber or a body of resilient material. The base member 20 includes a projection 26 extending upwardly from a center portion of the upper surface of the plate 22. The projection 26 includes a rounded upper surface 28 and a side surface 30 that tapers downwardly and outwardly to the upper surface of the plate 22. The upper surface of the plate 22 also includes a plurality of attachment points 24 for attaching the lower rings 14 to the base member 20. The upper ring 12, the lower rings 14, and the base member 20, when connected together, form a goal assembly indicated generally at 21 in FIG. 2. The lower plate 32 of the base member 20 is preferably operable to be attached to a mounting surface (not shown). While the rings 12 and 14 and the upper plate 22 have been deto said at least one lower ring, said base member including a shock adsorbing means, whereby when the object passes downwardly through said upper opening and contacts said base member, said base member prevents the object from being retained in said goal apparatus and directs the object to exit through said at least lower one ring, and said shock absorbing means prevents the object from exiting said goal apparatus through said upper opening.

What is claimed is:

1. A goal apparatus comprising:

a generally horizontal upper ring, said upper ring defining an upper opening sized to receive a thrown object of a predetermined size and shape;

at least one lower ring defining a lower opening for passage of the object, said lower ring being attached at a point to said upper ring and extending inwardly and downwardly from said attachment point; and a base member positioned below said upper ring and being attached to said at least one lower ring, said base member including a shock adsorbing means, whereby when the object passes downwardly through said upper opening and contacts said base member, said base member prevents the object from being retained in said goal apparatus and directs the object to exit through said at least lower one ring, and said shock absorbing means prevents the object from exiting said goal apparatus through said upper opening.

2. The apparatus according to claim 1 wherein said upper ring and said at least one lower ring are circular in shape.

3. The apparatus according to claim 1 wherein said upper ring and said at least one lower ring are of a same diameter as a regulation basketball hoop.

4. The apparatus according to claim 1 wherein said at least one lower ring is at least one of a different size and shape than said upper ring.

5. The apparatus according to claim 1 wherein said upper ring and said at least one lower ring are constructed of a lightweight material.

6. The apparatus according to claim 1 wherein said base member includes an upwardly extending projection having a rounded upper surface connected to a downwardly and outwardly tapering side surface for contacting the object.

7. The apparatus according to claim 1 wherein said shock adsorbing means is at least one of a spring and a damper.

8. The apparatus according to claim 1 including two additional lower rings each defining a lower opening for passage of the object, said additional lower rings each being attached at an associated point to said upper ring and extending inwardly and downwardly from said associated attachment point to said base member.

9. A goal apparatus comprising:

a generally horizontal upper ring, said upper ring defining an upper opening sized to receive a ball of a predetermined size and shape;

three lower rings each defining a lower opening for passage of the ball, said lower rings each being attached at an associated first attachment point to said upper ring and extending inwardly and downwardly from said associated first attachment point, adjacent ones of said lower rings being attached at associated second attachment points;

a base member positioned below said upper ring and being attached to each said lower rings at an associated third attachment point, said third attachment points being spaced apart to permit the ball to contact said base member; and a support assembly being attached to said base member for retaining said upper ring a predetermined distance above the ground, said support assembly including a pole having an upper end attached to said base member and a lower end attached to a plurality of ground engaging legs by a rotatable support member, and a downwardly extending pendulum attached to said rotatable support member for maintaining said pole in generally vertical orientation, whereby when the ball is directed downwardly through said upper opening and contacts said base member, said base member directs the ball to exit through one of said lower rings.

10. A goal apparatus comprising:

a generally horizontal upper ring, said upper ring defining an upper opening sized to receive a ball of a predetermined size and shape;

three lower rings each defining a lower opening for passage of the ball, said lower rings each being attached at an associated first attachment point to said upper ring and extending inwardly and downwardly from said associated first attachment point, adjacent ones of said lower rings being attached at associated second attachment points;

a base member positioned below said upper ring and being attached to each said lower rings at an associated third attachment point, said third attachment points being spaced apart to permit the ball to contact said base member wherein said base member includes a shock adsorbing means for preventing the ball from exiting said goal apparatus through said upper opening; and a support assembly being attached to said base member for retaining said upper ring a predetermined distance above the ground whereby when the ball is directed downwardly through said upper opening and contacts said base member, said base member directs the ball to exit through one of said lower rings.

11. The apparatus according to claim 10 wherein said shock adsorbing means is at least one of a spring and a damper.

* * * * *